United States Patent [19]

Frankel

[11] 4,039,123

[45] Aug. 2, 1977

[54] AUTOMATIC STACK DAMPER

[75] Inventor: Seymour Frankel, Commack, N.Y.

[73] Assignee: Flair Manufacturing Corporation, Hauppauge, N.Y.

[21] Appl. No.: 605,948

[22] Filed: Aug. 19, 1975

[51] Int. Cl.[2] ..... F23N 3/00; F23J 11/00

[52] U.S. Cl. ..... 236/1 G; 126/285 B

[58] Field of Search ..... 236/1 G, 16; 110/163, 110/285 B; 126/295, 293

[56] References Cited

U.S. PATENT DOCUMENTS

| | | | |
|---|---|---|---|
| 2,037,363 | 4/1936 | Branche | 236/16 |
| 3,580,238 | 6/1968 | Diehl | 126/295 |

*Primary Examiner*—William E. Wayner

*Attorney, Agent, or Firm*—Burgess, Dinklage & Sprung

[57] ABSTRACT

An improvement in a system comprising a heat stack, a damper having a vane in said heat stack, actuating means for opening and closing said damper, the actuating means being electrically connected to and responsive to a thermostat in an electrical circuit containing the heating means for generating heat, the by-products from which pass through the heat stack, the improvement residing in that the actuating means comprises an electric motor which is spring biasedly connected to the vane, the electric motor being in a normally "On" position having current passing therethrough and holding said vane against the action of said spring in a closed position. Means are provided to deactivate the motor and allow the spring to return the vane so that the stack is in an open position.

10 Claims, 5 Drawing Figures

AUTOMATIC STACK DAMPER

BACKGROUND OF THE INVENTION

1. Field of the Invention

This invention relates to an improvement in a dampening system, particularly of the type employed in heating operations. More particularly, this invention relates to an improvement in a dampening system whereby the vane of the dampener is positively maintained in a closed position when the system is not being used for heat generation, but is returned to an open position upon commencement of a heating operation. This invention is particularly directed to a dampening means in which the vane is held in a closed position by actuation of an electric motor, which electric motor is deenergized in response to a thermostat, whereby de-energization of the motor causes a heating cycle to commence after a short time delay.

2. Discussion of the Prior Art

Numerous dampening systems for use in heat and smoke stacks have been heretofore proposed. Such systems are typified by those disclosed in U.S. Pat. Nos. 2,977,437, 3,273,625, and 3,580,238. In U.S. Pat. No. 3,580,238, there is disclosed a system in which the vane of the dampening means is opened upon the introduction of power to a solenoid. A major disadvantage of this system is found particularly in systems having manually operated gas valves. Should there be a power failure combustion could still be made to take place in such a system while the vane remains shut, i.e., the electric power would not open the vane, and thus, combustion would build up within an otherwise closed system. Such a system represents a serious saftey hazard. Additionally, the system employs Teflon or other thermoplastic bearings which will not endure the temperatures normally generated in the stack. Other materials such as silicone rubber are employed in the form of pads to provide both an escape path for pilot combustion products and for cushioning the noise of the sudden vane stoppage at the end of its stroke. Silicone rubber, unfortunately, will not withstand temperatures higher than 575° F, temperatures which are readily exceeded in a gas or oil fired heating system.

U.S. Pat. No. 3,273,675 similarly employs power to open the vane upon commencement of a heating cycle. It also suffers from the same disadvantages inherent in the apparatus of U.S. Pat. No. 3,580,238. Therein, there is proposed to employ a uni-directional double oscillator motor. Unfortunately, the use of such an oscillating device is accompanied with noise which resounds throughout the heating system, particularly if the heating system is one which contains large surfaces of sheet metal, e.g., as found in hot air heating systems.

It has, therefore, become desirable to provide an improved damping system which is simply constructed, does not require the use of substances which will degrade at the temperatures generated in the system, is virtually noise-free, and, most importantly, insures that should there be a power failure, the vane of the dampener will be automatically disposed in an open position. These and other objects are accomplished by the invention as will appear from the disclosure below.

SUMMARY OF THE INVENTION

In accordance with the invention there is provided an improvement in a system comprising a heating stack and, a damper having a vane in said heating stack, actuating means for opening and closing said damper, said actuating means electrically connected to and responsive to a first thermostat in an electrical circuit containing a heating means for generating heat, the by-products from which pass through said stack, the improvement residing in that said actuating means comprises an electric motor which is spring biasedly connected to the vane, the electric motor being in an On position having current passing therethrough when said vane is closed, said electric motor holding said vane against the action of said spring in said closed position. The device comprises means responsive to the closing of a thermostat for deactivating or de-energizing the electric motor.

In accordance with the invention there is provided such a heating system which employs an electric motor which in normal position, i.e., when heating is not taking place, is in an On condition so as to maintain, under the electromechanical energy developed, the vane in a closed position. The electric motor has a rotary output shaft which engages a vane shaft connected to the vane and disposed exteriorly of the heating shaft. The vane itself is rotationally mounted in the heating stack. The vane shaft is engaged by a spring member which, in a semi-untensioned state, holds the vane shaft such that the vane attached thereto is in an open position. By such a construction, when the motor is deactivated and tension is no longer exerted by the motor on the spring, the spring will release, thereby rotating the vane shaft so as to dispose the vane within the heating stack in an open position.

Preferably, the spring which is engaged about the vane shaft is a coil spring in the nature of a torsion coil spring. On one end thereof, it engages to the vane shaft through a coupling, while on the other end thereof it engages a stationary plate. This stationary plate, in turn, can be one through which the vane shaft passes, and it can be suitably equipped with bearing members and the like to facilitate rotation of the vane shaft.

In a preferred embodiment of the invention, there is a set of electrical switching contacts mounted for rotation about either the rotary output shaft of the electric motor or on the vane shaft. Rotation of the vane shaft or the rotary output shaft of the electric motor causes rotation of these contacts so that they open or close an electric circuit. They are disposed preferably on a wafer such as a phenolic resin wafer, and close a circuit when the torsion spring moves the vane into an opened position. The circuit which is closed is one which includes means for commencing a heating operation. For instance, it can include a circuit containing a burner such as of the type employed in an oil burner. Alternatively, the switches can be in a circuit including an electrically responsive valve in a gas conduit line whereby the valves are open to allow gas of the type which is ignitable to pass into a firing chamber where it is ignited. In either embodiment, the opening of the vane in the heating stack necessrily occurs before any heating operation. Heating then continues with the assurance that the vane is safely open, thereby precluding the possibility of an undesirable restriction within a closed system. Obviously, even should there be a power failure, the vane will be automatically opened, since it is electrical power which, via the electric motor, serves to maintain the same in a closed position. Therefore, there is no danger that in a manually valved gas fired system the damper will be closed while the gas is being ignited.

According to the invention in a preferred mode the damper means is responsive ultimately to the closure of a first thermostat such as a room thermostat. This thermostat preferably upon closure completes a circuit which energizes a coil, which coil, in turn, throws a first relay switch in a second circuit. The second circuit contains a second coil which, in turn, is energized upon completion of the second circuit, which coil opens a normally closed relay. The normally closed relay is in an electrical circuit containing the electric motor. When the normally closed relay is open, the electric motor is deactivated, thereby allowing the torsion spring to act and to rotate the shaft of the electric motor and the vane shaft to an open position. This places the system in condition for operation.

Together with rotation of the vane shaft, the electric switches mounted thereon or mounted on the electric motor cause a further circuit containing a heating means to close, whereby the same can be actuated.

In a further preferred embodiment, the apparatus is equipped with a vent thermostat disposed upstream of the damper, preferably between the heating means, e.g., burner, gas firing chamber, or the like, and the vent damper. This vent thermostat is in an electrical circuit containing the electric motor. The purpose of the vent thermostat is to prevent reactivation of the electric motor following a heating cycle until the the fumes within the stack have been eliminated to the desired point. This prevents the damping means from being closed while there are still combustion products, in the stack. All of the above described features will become apparent from the complete description below.

BRIEF DESCRIPTION OF THE DRAWINGS

Referring to the drawings herein.

DESCRIPTION OF SPECIFIC EMBODIMENTS

Figure 1:
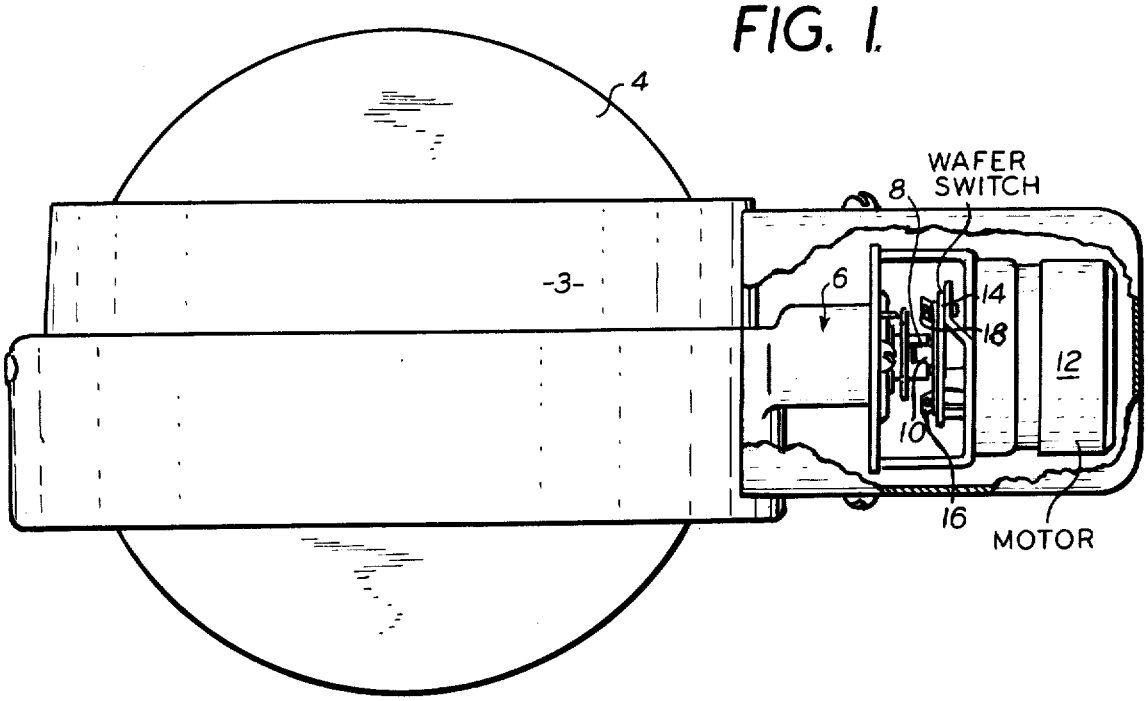
FIG. 1 is a side view, partially broken away, of a means of the invention showing the vane in an open position and carried in a vane carrier 3.

Referring to FIG. 1, there is shown a side view of a vent damper housing 3 equipped with a vane 4 of a damping system, this vane 4 having an exteriorly disposed vane shaft 6 which is coupled at 8 to the output shaft 10 of an electric motor 12. Disposed about the output shaft 10 of the electric motor 12 is a phenolic wafer 14 bearing switch contacts 16 and 18. It is to be understood that rotation of shaft 10 by virtue of electric motor 12 causes the contacts 16 and 18 to rotate and to make or break contacts with contacts in electrical circuitry shown in the other figures.

Figure 2:
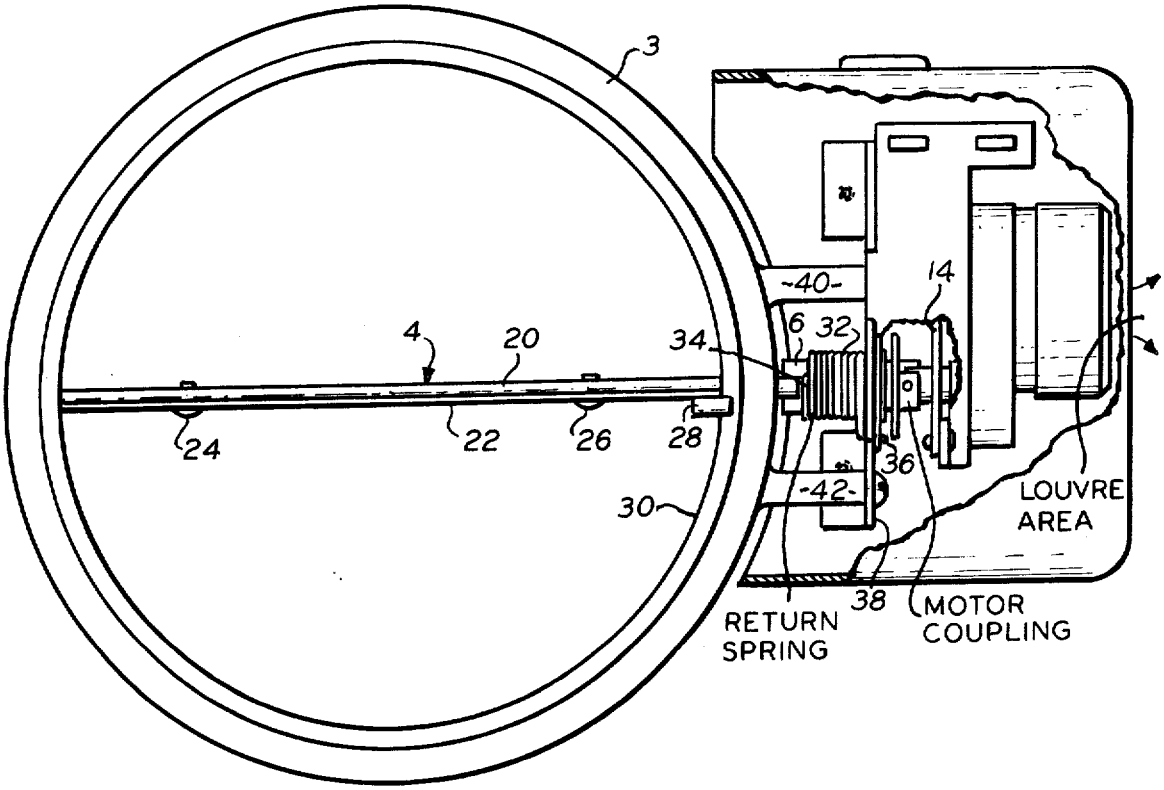
FIG. 2 is a top plan view of FIG. 1 broken away differently to show the torsion spring mechanism and its interrelationship to the vane shaft and the shaft from the electric motor.

Referring to FIG. 2 there is also shown the housing 3 in which the vane 4 is disposed. Vane 4 is in the form of plate 22 and shaft 20 secured by fasteners 24 and 26. A stop pin member 28 is disposed interiorly through an inner wall 30 of housing 3 to insure that the vane remains parallel to the flow of gases through the stack when it is in a fully opened position. Exteriorly of the housing 3 is the vane coupling 6 on which is engaged a coil type torsion spring 32. One end 34 of the spring is engaged within the coupling 6 itself, while the other end 36 is engaged by a stationary plate 38 which can conveniently be connected to housing 3 by use of legs 40 and 42, as shown.

Figure 3:
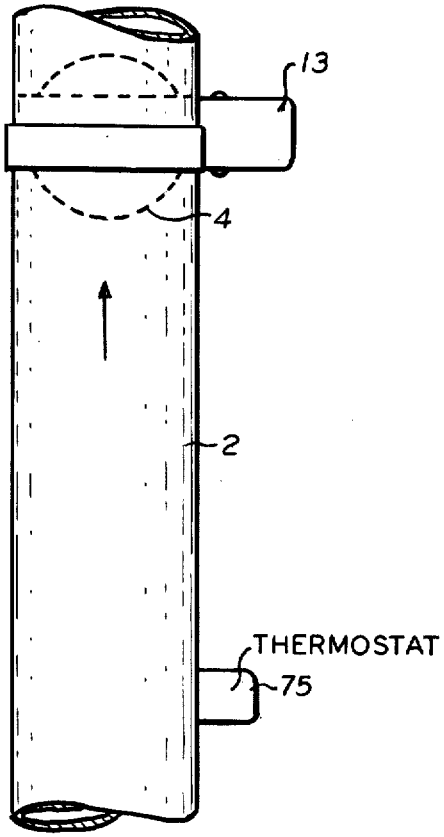
FIG. 3 is a side view showing the stack in FIGS. 1 and 2 in which the dampening means of the present invention is connected, FIG. 3 also showing the upstream disposition of vent thermostat.

Referring to FIG. 3 there is shown the heating stack 2 equipped with the vane 4 in the damping system. The motor is housed within housing 13. In a preferred embodiment there is situated upstream of the vane and the damping system a vent thermostat 75, the operation of which is described below.

Figure 4:
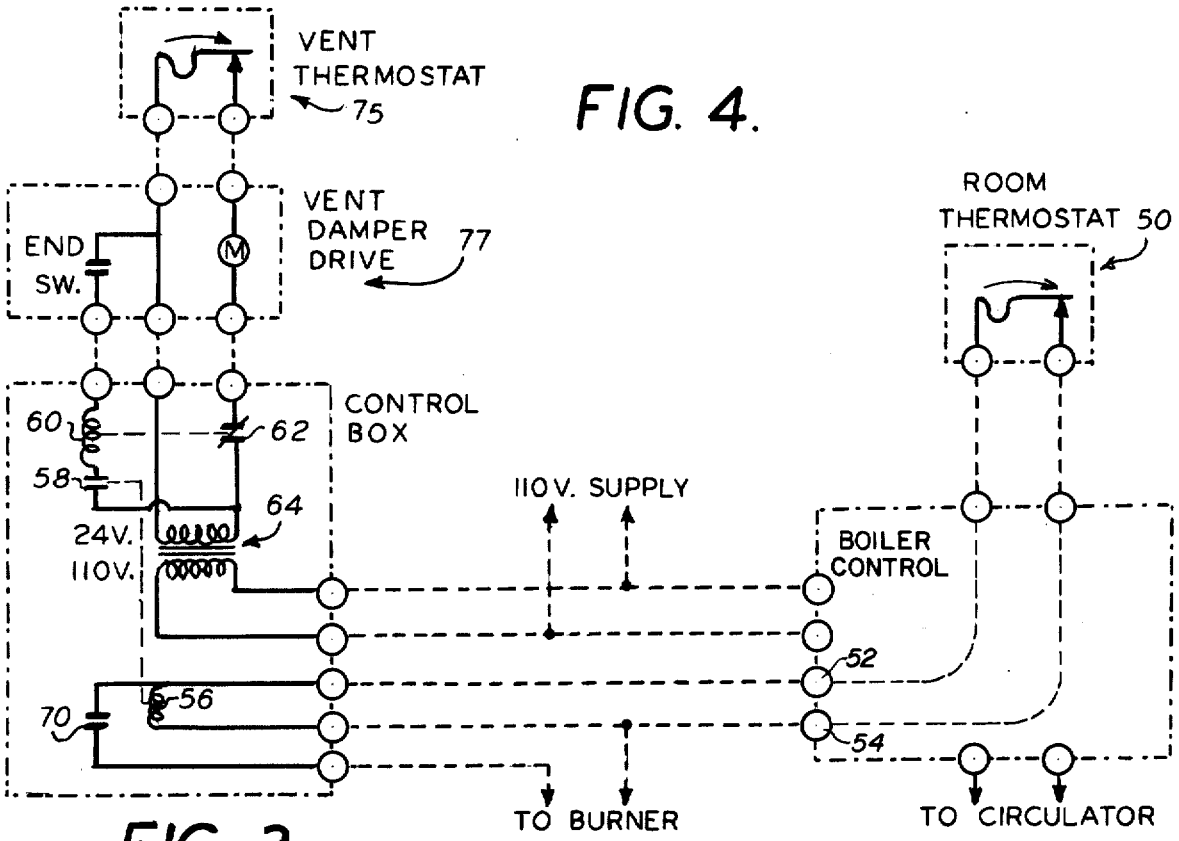
FIG. 4 is an electrical circuit diagram showing typical circuitry for the installation of the vent damper of the invention in connection with a boiler control, the wiring of FIG. 4 being useful in oil fired systems or gas fired systems employed with domestic hot water.

Referring to FIG. 4, when the room thermostat 50 closes to a demand condition, the boiler control terminals 52 and 54 are energized. In turn, the relay coil 56 is energized, whereby to close the relay 58. When relay 58 is closed, the coil 60 is energized. Coil 60 is interconnected with the normally closed relay 62 whereby to cause the same to open. This will deactivate the motor 12. When the motor 12 is deactivated no positive pressure is being applied to hold the vane 4 in closed position. This allows the spring to rotate the vane 4 until it abuts the stop 28 once it is in an open position so as to allow the escape of the products of combustion through the heat stack 2.

When this occurs the wafer 14 is rotated with the rotation of the vane coupling 6 and the shaft of the motor. This, in turn, causes the switches 16 and 18 to complete a circuit whereby to close the relay 70. This completes the circuit to the burner, allowing the burner to commence heating.

In FIG. 4 there is also shown the manner in which a room thermostat is connected to a boiler control whereby the control of the heating system is through the boiler control. Obviously, the room thermostat can measure the ambient temperature of a room and relay this information directly to the burner, by-passing any boiler control. Such is the case in systems in which gas fired boilers or furnaces are employed without domestic hot water. Such a system is shown in FIG. 5.

In FIG. 4 there is also shown the manner by which the vent thermostat 75 is connected to the vent damper drive 77. The purpose of the vent safety thermostat is to insure that when the heating cycle is complete and the room thermostat moves into open position, the motor on the vent damper drive is not engaged until the fumes in the stack have decreased to a desired level. Obviously, if no vent thermostat 75 were included, the motor would be activated simultaneously with the burner shutdown whereby the vane 4 would be disposed horizontally in the stack 2. Since gaseous combustion products may still reside upstream of the vane 4 in stack 2, an accumulation of materials could occur. Thus, a vent thermostat 75 is connected to the vent damper drive 77 whereby the vent damper drive cannot be reactivated until the temperature at the thermostat 75 is decreased below a fixed level.

In operation, when the room thermostat 50 has been satisfied, the circuit is open, thereby de-energizing coil 56. De-energization of coil 56 causes relay 58 to open thereby de-energizing coil 60 in the low voltage circuit which is fed with current via transformer 64. When coil 60 is de-energized, the normally closed relay 62 is opened, whereby to complete the circuit, but for the vent thermostat 75, of the vent damper drive. When the vent safety thermostat 75 closes upon a decrease of temperature in the heat stack, the circuit is complete, and the motor M is energized. When the motor M is energized, the motor shaft 10 rotates which in turn causes rotation of the vane coupling 6 against the action of the torsion return spring 32. This causes vane 4 to rotate to a horizontal position and to be held in that position by the positive action of the electric motor M.

Figure 5:
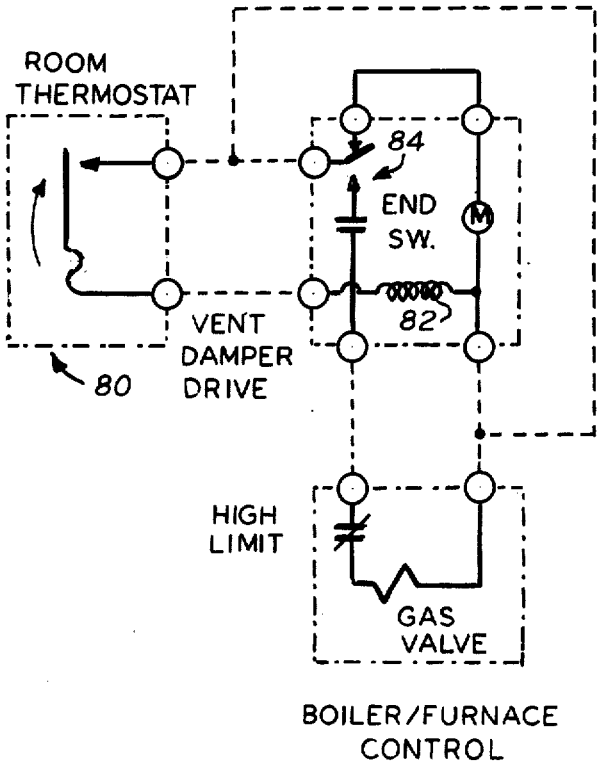
FIG. 5 is a schematic electrical diagram similar to FIG. 4 showing the system schematically for a gas fired boiler or furnace without domestic hot water supply.

FIG. 5 shows the manner by which the system of the invention is interconnected to a gas fired boiler or furnace. Here, the system is analogous to that described above in respect of FIG. 4. The principal differences resides in the facts that: (A) no vent thermostat is necessary in a gas fired system; and (B) when the room thermostat 80 closes, the coil 82 is energized. When coil 82 is energized it closes the normally open contacts and opens the normally closed contacts (both sets shown at 84) in series with the drive motor. The motor, having been disconnected from its electrical power, is driven toward a vane-open position by the torsion spring. As the vane opens, the wafer-type end switch is mechanically brought to a closed position, and the electrical circuit to energize the gas valve is completed.

The description above serves to illustrate the various means by which the damper of the invention can be put to practice. It will be realized that while the invention has been illustrated particularly with reference to the regulation of damping in oil fired or gas fired heating units with or without domestic hot water, the damper can be used in virtually any system wherein an analogous process is being performed. For instance, dryers as employed on drying machines, particularly for drying clothes, are also equipped with vent pipes which carry heated air from the dryer to the atmosphere. The damper means of the invention can suitably be employed to regulate the vane member of such a dryer. Similarly, the apparatus can be used for any heating mechanism, including water heaters, heating chambers and other appliances. The device is suitable for installation in appliances and heating systems employed in the home as well as in apartment houses, office buildings, commercial plants, and the like.

It should be further understood that the description above serves only to illustrate several embodiments of the invention. The principle of the invention lies in the use of a normally On electric motor which positively holds a vane in a closed position whereby upon loss of power or actuation of the damper system, the motor is shut off and a spring member or the like causes the vane to open and to permit a heating cycle to commence. It will be apparent that the classic torsion spring shown in FIGS. 1 and 2 can be replaced by a spring or other resilient member which performs a similar function such as a flat coil power spring also known as a clock or motor spring. Other return mechanisms can also be employed provided they are actuated upon deactivation of the electric motor or upon a state in response to or simultaneous with the motor deactivation.

The invention has been illustrated in a preferred embodiment as including a vent thermostat. The vent thermostat is only one means by which it can be insured that the motor is not reactivated too soon and the vane closed while there are still combustion products and heat rising in the stack 2. Instead of employing a vent thermostat, one can employ a time delay mechanism, a pressure switch or a flame detector. The flame detector can be of the type including an electric eye.

It will be apparent from the above disclosure that numerous modifications and embodiments will be obvious to one of skill in the art. Accordingly, the invention should not be construed as limited to the embodiments shown and described herein, or portions thereof, as various modifications and departures will be apparent to one of skill in the art.

What is claimed is:

1. In a system comprising a heat stack, a damper having a vane in said heat stack, actuating means for opening and closing said damper, said actuating means electrically connected to and responsive to a first thermostat in an electrical circuit containing a heating means for generating heat, the by-products from which pass through said stack, the improvement wherein said actuating means comprises an electric motor spring biasedly connected to said vane, said electric motor in an On position having current passing therethrough and holding said vane, against the action of said spring, in a closed position, and means responsive to the closing of said thermostat for deactivating said motor, said means responsive to the closing of said thermostat comprising a coil in the electrical circuit containing said thermostat which is energized upon closure of said thermostat which throws a first relay switch in a second circuit containing a second coil, which coil is energized upon completion of the second circuit containing said first relay switch, said second coil connected to a normally closed relay which is opened upon energization of said second coil, said second relay being in the electrical circuit of said electric motor, whereby when said second relay is open, the circuit of said motor is broken and the output shaft of said electric motor rotates.

2. A system as claimed in claim 1 wherein said electric motor has a rotary output shaft, said vane is rotationally mounted in said heat stack and has a vane shaft connected thereto which is disposed exteriorly of said heat stack, said vane shaft is engaged by a spring member which in a semi-untensioned state holds said vane shaft such that the vane attached thereto is in an open position.

3. A system as claimed in claim 2 wherein said spring is a torsion coil spring, one end of which is engaged by said vane shaft, the other end of which is engaged by a stationary plate through which said vane shaft passes.

4. A system as claimed in claim 2 wherein said said rotary output shaft has mounted theron for rotation with said shaft a pair of electrical switch contacts.

5. A system as claimed in claim 4 wherein said electrical switch contacts, in closed position, complete an electrical circuit which includes an electrical ignition means for commencing the heating in a heating chamber, the by-products from which pass through said stack.

6. A system as claimed in claim 5 wherein the electrical switches on said output shaft are in an electrical circuit containing a heating means when said electric motor is de-energized whereby to complete said circuit.

7. A system as claimed in claim 6 wherein upstream of said damper in said stack there is a vent thermostat which is in the electrical circuit for driving said electric motor to allow said motor to be energized.

8. A system as claimed in claim 7 wherein said first thermostat is connected to a boiler.

9. A system as claimed in claim 6 wherein said heating means comprises a conduit for feeding an ignitable gas into a fire chamber and means for igniting said gas, the combustion products from which pass through said stack.

10. A system as claimed in claim 9 wherein said electrical switch contacts are in an electrical circit containing an electrically responsive valve means, whereby upon de-energization of said electric motor and rotation of said vane shaft said electrical switch contacts complete the electrical circuit containing said electrically responsive valve which permits said gas to enter said fire chamber.

* * * * *